US011371281B2

(12) United States Patent
Zutler et al.

(10) Patent No.: US 11,371,281 B2
(45) Date of Patent: Jun. 28, 2022

(54) TELESCOPING SWING GATE

(71) Applicant: GLOBAL INDUSTRIAL DISTRIBUTION INC., Port Washington, NY (US)

(72) Inventors: Bruce Zutler, Port Washington, NY (US); Joshua O'Brien, Arden, NY (US)

(73) Assignee: GLOBAL INDUSTRIAL DISTRIBUTION INC., Port Washington, NY (US)

( * ) Notice: Subject to any disclaimer, the term of this patent is extended or adjusted under 35 U.S.C. 154(b) by 12 days.

(21) Appl. No.: 16/992,383

(22) Filed: Aug. 13, 2020

(65) Prior Publication Data

US 2022/0049543 A1 Feb. 17, 2022

(51) Int. Cl.
*E06B 9/04* (2006.01)
*E06B 11/02* (2006.01)
*E06B 9/00* (2006.01)

(52) U.S. Cl.
CPC ..... *E06B 9/04* (2013.01); *E06B 11/02* (2013.01); *E05Y 2900/40* (2013.01); *E06B 2009/002* (2013.01)

(58) Field of Classification Search
CPC ..... E06B 2009/002; E06B 9/02; E06B 9/04; E06B 9/06; E06B 11/02; E06B 11/022; E05Y 2900/40
See application file for complete search history.

(56) References Cited

U.S. PATENT DOCUMENTS 2,531,310 A * 11/1950 Tonn ..... E06B 11/02 160/223
2,701,927 A * 2/1955 Dyer ..... E06B 11/02 49/163
5,704,164 A * 1/1998 Huang ..... E06B 9/02 160/372
5,921,027 A * 7/1999 Siebenahler ..... E06B 11/04 49/160
6,161,334 A * 12/2000 Goodin ..... A01K 1/035 49/125
2012/0056144 A1* 3/2012 Woods ..... E06B 11/02 256/73
2013/0219790 A1* 8/2013 Honeycutt ..... E06B 3/921 49/176

(Continued)

*Primary Examiner* — Justin B Rephann
(74) *Attorney, Agent, or Firm* — Troutman Pepper Hamilton Sanders LLP

(57) ABSTRACT

A design for a universal telescoping swing gate can be sized to obscure a wide range of openings while accommodating a multitude of installation options to make the gate versatile under many conditions. The swing gate can have a frame with a pivot member rotatable about a mounting seat between an open configuration and a closed configuration. The frame can have first and second telescoping members adjustable along an extension axis between a collapsed state and a fully extended state for changing the frame length so the gate can be quickly furnished to different sized openings. The gate can be spring loaded to bias the frame to a nominally closed position to reduce the chance for human error among workers. The gate can also be sized to have the structural rigidity to comply with OSHA requirements for handrails and guardrails around a walking-working surface.

21 Claims, 11 Drawing Sheets

(56) References Cited

U.S. PATENT DOCUMENTS

| | | | | |
|---|---|---|---|---|
| 2015/0330142 | A1* | 11/2015 | Pilgrim | E05D 3/02 49/465 |
| 2017/0350165 | A1* | 12/2017 | Schort | E05B 65/0014 |
| 2018/0274288 | A1* | 9/2018 | Wang | E06B 9/02 |
| 2019/0003250 | A1* | 1/2019 | Flannery | E06B 9/06 |
| 2019/0218730 | A1* | 7/2019 | Satrom | E06B 9/02 |
| 2020/0370370 | A1* | 11/2020 | Satrom | E06B 11/00 |

* cited by examiner

TELESCOPING SWING GATE

FIELD OF THE INVENTION

The present disclosure generally relates to devices and methods for obscuring the openings on walking-working surfaces. More specifically, the present disclosure relates to a universal safety gate for walking-working on such surfaces.

BACKGROUND

There are many situations on both temporary and permanent walking-working surfaces where a door or gate is opened often to facilitate access therethrough yet should remain closed the majority of the time for safety. To this end, the industry has configured many types of automated opening/closing systems for obscuring these openings to maintain workplace safety. The dynamic and often custom needs of construction, industrial, and other temporary environments also create platforms, access openings, ladders, doorways, and other conditions on which workers are required to be protected from hazards. A safety swing gate is often used to occlude openings which can otherwise pose a fall or trip hazard while maintaining a nominally closed posture.

The potential conditions pose a variety of hazards and challenges for the design of safety swing gates. Many job sites have structures and working surfaces that change often and rapidly. For example, a site can have many openings of various dimensions, and gates with fixed frame sizes or limited adjustability can lack the range to adequately and safely cover all the openings. This would require sourcing of additional duplicative gates where a more versatile design can otherwise have been universally used. As a result, universal gates with designs tailored to handle the broadest possible range of applications are preferred because they can be reused and adapted as circumstances require. For example, it is desirable that gates be expandable so that they can accommodate openings of various widths while providing the required level of interference.

Due to the nature of the mentioned working surfaces, adjacent features and/or structures are not always known and may not be consistent from job site to job site. For example, some situations can require closure of an opening between two scaffolding posts. Other may feature a bannister opposite a wall. Elevated surfaces can have stairways or ladders for access, where a safety gate prevents unintended entrance or exit which can expose individuals to potential injury. It is important, therefore, that mounting and installation options for the gates be flexible so that the gates have the capability of being positioned between a wide variety of potential supports and allow gates to be removed or repositioned. Removable swing gates can be used, for example, in an industrial setting where equipment have rarely used platforms for servicing or maintenance.

A gate can have a self-closing setup to always be biased towards a closed configuration, such as through spring loading or other mechanical means. A self-closing feature can allow workers to know the expected position of a gate during all situations where access to the opening is not necessary or imminent. A self-closing features also aids in situations where an inadequately closed or improperly latched gate presents a hazard that may not be readily recognizable to those in the area.

Many existing swing gate designs are not robust enough to be used in, for example, the construction or industrial settings where large equipment and structures mean high loads can be experienced. An expandable swing gate would need to have strong joints between expanding sections to prevent the frame from significant deflection or even buckling when loaded. The expandable gates with the widest spans can be the most versatile in terms of utility, but be incapable taking significant torque loads, especially at maximum extension. Many gate designs are also incapable of meeting OSHA requirements for the other handrails and guardrails which are required around walking-working surfaces, adding risk for a potential user. The expense of more stringent design and testing to be OSHA compliant can be a significant hurdle to the extent that becoming compliant is a task not undertaken with many swing gate designs currently on the market.

SUMMARY

The designs herein can be for a universal telescoping swing gate for obscuring openings capable of meeting some or all of the design challenges mentioned above. The openings to protect can be staircase openings, ladder access openings, scaffold systems, mezzanine edges, elevated work platforms, or any others as known in the art. The swing gate can have features making it very versatile for a wide possible range of applications. The gate can also feature rugged construction sized to meet requirements for guardrails of walking and working surfaces and be spring loaded to ensure the gate nominally closes off the opening.

A swinging safety gate can have a frame rotatable about a shaft between an open configuration and closed configuration. The safety gate can be capable of obscuring an opening having a length defined by the perimeter of the frame. The gate can be a universal design in that the frame is both extendable to cover a wide range of opening sizes while also capable of attaching to a wide variety of posts, walls, or other structures when installed. The frame can have a longitudinal extension axis where frame members can telescope between a collapsed state and a fully extended state.

The frame can have a pivot member rotatable about a rotation axis of a shaft at a proximal end of the frame. As the frame is rotated from a closed configuration or an open configuration, one or more torsion springs can be tensioned to nominally bias motion from the open configuration to the closed configuration. A first telescoping member can be disposed distal of the pivot member and be configured to slide and telescope along the extension axis relative to the pivot member. A second telescoping member can be disposed distal of the first telescoping member and be configured to slide and extend along the extension axis relative to the first telescoping member.

The gate can also have a bracket or mounting seat allowing for attachment of the gate to a variety of surfaces and/or objects. For example, the gate can be attached to the post of a scaffold structure or other fabrication and secured around the post using a U-bolt. In a separate example, the gate can be attached to a fixed structure with a flat planar surface, such as a wall or the studs of a section of framing.

One or more proximal collars can be disposed around the circumference of the longitudinal members of the pivot member and first telescoping member. The collars can be threaded to internal inner connectors and rotatable between a locked and unlocked position. When locked, the collars fix the relative position of the first telescoping member by prohibiting further sliding along the extension axis of the telescoping member out of the pivot member. The position can be locked at an intermediate distance, or the first telescoping member can be allowed to slide to a fully extended state along the extension axis.

Similarly, one or more distal collars can be disposed around the circumference of the longitudinal members of the first telescoping member and the second telescoping member. Similar to the proximal collars, the distal collars can be threaded to inner connectors and be configured to rotate between a locked and unlocked position. When locked, the collars fix the relative position of the second telescoping member with by prohibiting further sliding along the extension axis of the second telescoping member out of the first telescoping member.

The distal collars can be locked or unlocked independently of the proximal collars so that the extended positions of the first and second telescoping members can be selected individually. If both the first and second telescoping members are drawn out to the fully extended state along the extension axis, the length of the opening obscured by the gate can grow substantially. In one example, the length can grow by 50-90% when the frame is actuated from the collapsed state to the fully extended state. In another example, the length can grow by at least approximately 80%.

The safety gate can have a mounting seat configured to be attached to an external stationary mount or member, and a frame can rotate about a shaft coupled with the mounting seat. The stationary mount can be, for example, a scaffold or guardrail post. The stationary mount can also be a fixed wall or surface with a footprint at least as large or larger than that of the mounting seat so that a stable joint can be ensured.

The length of the frame used to obscure the opening can be controlled through the extension of the telescoping members. The distance along the extension axis between a proximally facing surface of the mounting seat and the distal most edge of the second telescoping member can define a perimeter frame length used to block the opening. By locking the collars at intermediate positions, the frame length can be shortened, but at a maximum when the frame is fully extended from the collapsed state to the fully extended state the frame length can increase by over 80%.

The gate can have a clapper plate removably disposed at a fixed position along the extension axis relative to the mounting seat. In one example, the clapper plate can be secured to the second telescoping member through a variety of means and be capable of arresting rotation of the frame as the swinging gate rotates from the open configuration to the closed configuration. In another case, the clapper plate can be removed from the second telescoping member and be connected to an external surface or member outside of the frame perimeter. In this way, when rotating the frame from the open configuration to the closed configuration the second telescoping member will come into contact with the clapper plate to arrest the rotation of the frame.

In another example, a device for obscuring an opening can rotate between an open configuration and closed configuration. The device can be configured to obscure an opening defined by a longitudinal length of the device. One or more torsion springs can be configured about the shaft to nominally bias motion from the open configuration to the closed configuration such that the gate is self-closing.

The frame can be extendable along an extension axis between a collapsed state and a fully extended state. The frame can have a pivot member rotatable on the shaft at a proximal end of the frame. A first telescoping member can be slidably disposed to move along the extension axis relative to the pivot member. A second telescoping member can be slidably disposed to move along the extension axis relative to the first telescoping member and first telescoping member remote from the proximal end.

The dimensions of the frame can be tailored so the gate can meet fall protection requirements necessary for many applications. The longitudinal length for obscuring the opening can be a wide range of dimensions based on the dimensions of the telescoping members. In one example the longitudinal length can be approximately 560 mm, and the pivot member can account for about 55% of that length when the frame is in the collapsed state. When the frame is spread to the fully extended position, the longitudinal length can be approximately 1015 mm and the pivot member can account for about 30% of that length as more of the first and second telescoping members are extended along the length.

The ratio of the nominal lengths of the first telescoping member to the length of the second telescoping member can also be varied. For example, the ratio can be tailored so that the frame has the structural rigidity to comply with OSHA or other loading requirements by having the frame supported over greater portion of its cantilevered length. In one case, the ratio of a first length of the first telescoping member to a second length of the second telescoping member can be approximately 0.78.

The outer diameter of the pivot member can be greater than the outer diameter of the first telescoping member. In an example, the longitudinal members of the pivot member can have an outer diameter of approximately 50 mm. The ratio of the outer diameter of the longitudinal members of the pivot member to the first telescoping member can be about 5:4, can be greater by 10 mm, or some other number. Similarly, the ratio of the outer diameter of the longitudinal members of the first telescoping member to the second telescoping member can be about 4:3, can be greater by 10 mm, or some other number. The inner diameter of the first telescoping member can be greater than the inner diameter of the second telescoping member by 7 mm or can also be some other number.

Similar to other disclosed designs the swinging gate can have a clapper plate removably disposed at a fixed position along the extension axis relative to the mounting seat. The clapper plate can be mounted to the frame at a fixed position along the extension axis, such as at the end of the second telescoping member. The swinging of the frame from the open configuration to the closed configuration can be arrested when the frame contacts the clapper plate.

All of these capabilities provide for a gate that is not significantly more complicated than existing devices but is more adaptable and otherwise rugged for reliable service. Other aspects and features of the present disclosure will become apparent to those of ordinary skill in the art, upon reviewing the following detailed description in conjunction with the accompanying figures.

BRIEF DESCRIPTION OF THE DRAWINGS

The above and further aspects of this invention are further discussed with reference to the following description in conjunction with the accompanying drawings, where like reference numbers indicate elements which are functionally similar or identical. The drawings are not necessarily to scale, emphasis instead being placed upon illustrating principles of the invention. The figures depict one or more implementations of the inventive devices, by way of example only, not by way of limitation.

DETAILED DESCRIPTION

The objective of the disclosed examples is a universal telescoping swing gate capable of covering a wide variety of possible openings at a work site through having extendable features and a flexible mounting arrangement. The examples can have a frame rotatable about a mounting seat and be spring loaded such that the gate is self-closing when opened. The frame can have a pivot member at the proximal end of the frame, and multiple telescoping members slidably disposed along an extension axis with the pivot member to adjust the size of the frame to cover a large range of differently sized openings. The dimensions and material of the pivot member and the first and second telescoping members can be chosen so the frame is capable of meeting OSHA or other structural standards related to guardrails.

The universal telescoping swing gate can also have a mounting seat bracket capable of attaching the gate to a variety of external members, such as post of exterior planar surface. A clapper plate can be disposed on or external to the frame so that it arrests rotation of the frame when the gate reaches a closed position.

A range of designs are envisaged for each of these elements as described, and it is intended that any of these elements can be used in conjunction with any other element, although to avoid repetition they are not shown in every possible combination. Examples are described in detail with reference to the Figures. While the description is in many cases in the context of installation in construction or industrial settings, the gate can be conceivably used in any application where a self-closing swing gate is needed. The environment can contain scaffolding, guardrails, ladders, elevated work platforms, or any of a number of well-known structures, which can be temporary or permanent. When these or similar products are employed in conjunction with the disclosure of this invention in the description below, their function and exact constitution are not described in detail.

Figure 1:
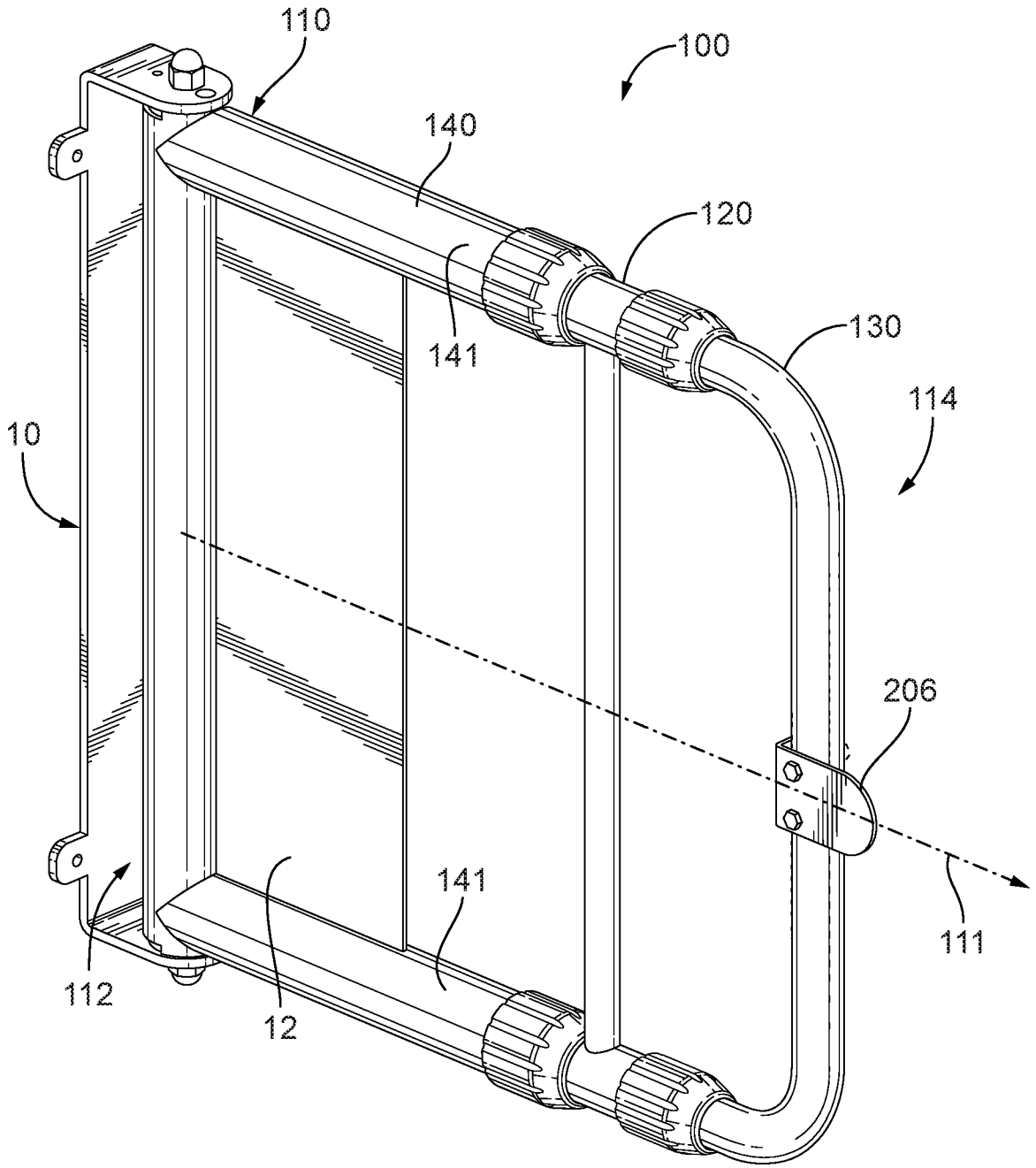
FIG. 1 is a perspective view of a universal telescoping swing gate according to aspects of the present invention.

Referring to FIG. 1, a universal telescoping swing safety gate 100 can have a proximal end 112 where the gate pivots and a frame 110 which extends distally to a distal end 114 to obscure an opening. The opening can be a floor opening, ladder entryway or exit, or any other situation where a fall hazard exists but where access is needed. For example, an elevated work platform at a construction site can be accessible by ladder, but workers must be protected from fall hazards at unprotected sides and edges such as the ladder opening, and therefore are required to be protected from the ladder opening while working.

The gate 100 can have telescoping capabilities so it can be adapted to cover a wide variety of openings. The frame 110 can be configured to rotate with respect to a mounting seat 10 which is used to connect the gate to an external stationary member such as a scaffolding or guardrail post. In other cases, the stationary member can be an adjacent structural wall or other planar surface. The mounting seat can be a bracket which can be bolted, screwed, adhered, or otherwise fixedly disposed. In many cases, the attachment hardware can allow the mounting seat to be removably disposed so the gate can be easily reused at different locations. In the example shown in FIG. 1, the seat has a proximally facing planar surface and a distally facing planar surface and tabs with holes through which mounting hardware can be used to connect the seat 10.

The frame 110 of the telescoping swing gate 100 can have a pivot member 140 approximate the proximal end 112 which serves as a hinge for the frame. The pivot member 140 can have one or more stabilizer plates 12 which can be braces which provides additional rigidity and stability to the frame 110. The stabilizer plate 12 can be a sheet as shown or can assume other geometry which can be, for example welded to the pivot member 140 but preferably extends the full height of the pivot member to directly link the top and bottom of the frame 110 near the proximal end 112, where loads applied near the distal end 114 of the frame greatest bending moment and potential deflection. The stabilizer plate 12 can also extend the full longitudinal length of the pivot member 140 and can be used to support printed indicia and other information and labels related to use or warnings regarding the surroundings.

Distal of the pivot member 140 can be a first telescoping member 120 slidably disposed relative to the pivot member 140. The frame 110 can have a longitudinal extension axis 111 parallel to the long axis of the frame. The first telescoping member 120 can have substantially tubular members which can extend into the sections of the pivot member 140 so the first telescoping member 120 can move telescopically proximal or distal with respect to the pivot member 140 along the extension axis 111 to adjust to a particular opening. Similarly, a second telescoping member 130 can be distal of the first telescoping member 120 with substantially tubular members configured to allow it to slide into and extend out from the first telescoping member along the extension axis 111 for additional range of extension. Having multiple telescoping members allows the gate to have greater application and location versatility when compared to a gate with a fixed frame or only a single telescoping member. The disclosed design offers this versatility while maintaining sufficient structural rigidity to protect the workers in the surrounding area from inadvertent falls from failure of the gate.

The frame 110 can telescope between a collapsed state and a fully extended state. A dual-telescoping, multi-diameter gate 100 as shown in various figures throughout this disclosure has several advantages. The gradually stepped diametric sizing of the different members can help to control stiffness transition and distribute external loads throughout the frame. Multiple expansion members also mean the swing gate 100 can be extended to almost twice or event more when compared to its length when collapsed.

Having multiple telescoping members also greatly increases the range of possible openings the gate is capable of obscuring. In the fully collapsed state shown in FIG. 1, the first and second telescoping members 120, 130 can be at their most proximal limit of travel in order to define the minimum opening which the telescoping swing gate 100 can obscure. In the collapsed state, the longitudinal tubular portions of the first telescoping member 120 are housed substantially within the longitudinal portions of the pivot member 140 and the longitudinal tubular portions of the second telescoping member 130 are housed substantially within the longitudinal portions of the first telescoping member 120. This reinforcement can make the collapsed state the stiffest and strongest position for the gate when subjected to external loads.

The frame 110 can preferably be made of steel tube stock in common and universally available sizes. Alternately, the frame can be formed or cut with custom sizing in order to tailor the strength and/or stiffness of the frame in various locations. The steel tubing construction can be both rigid and durable to ensure reliable service in harsh working conditions. The mounting seat 10 and frame 110 of the swing gate 100 can be powder coated or receive some other surface finish. A powder coating can be, for example, finished in safety yellow or another high-visibility finish to call attention to the hazard against which the gate can protect.

Figure 2:
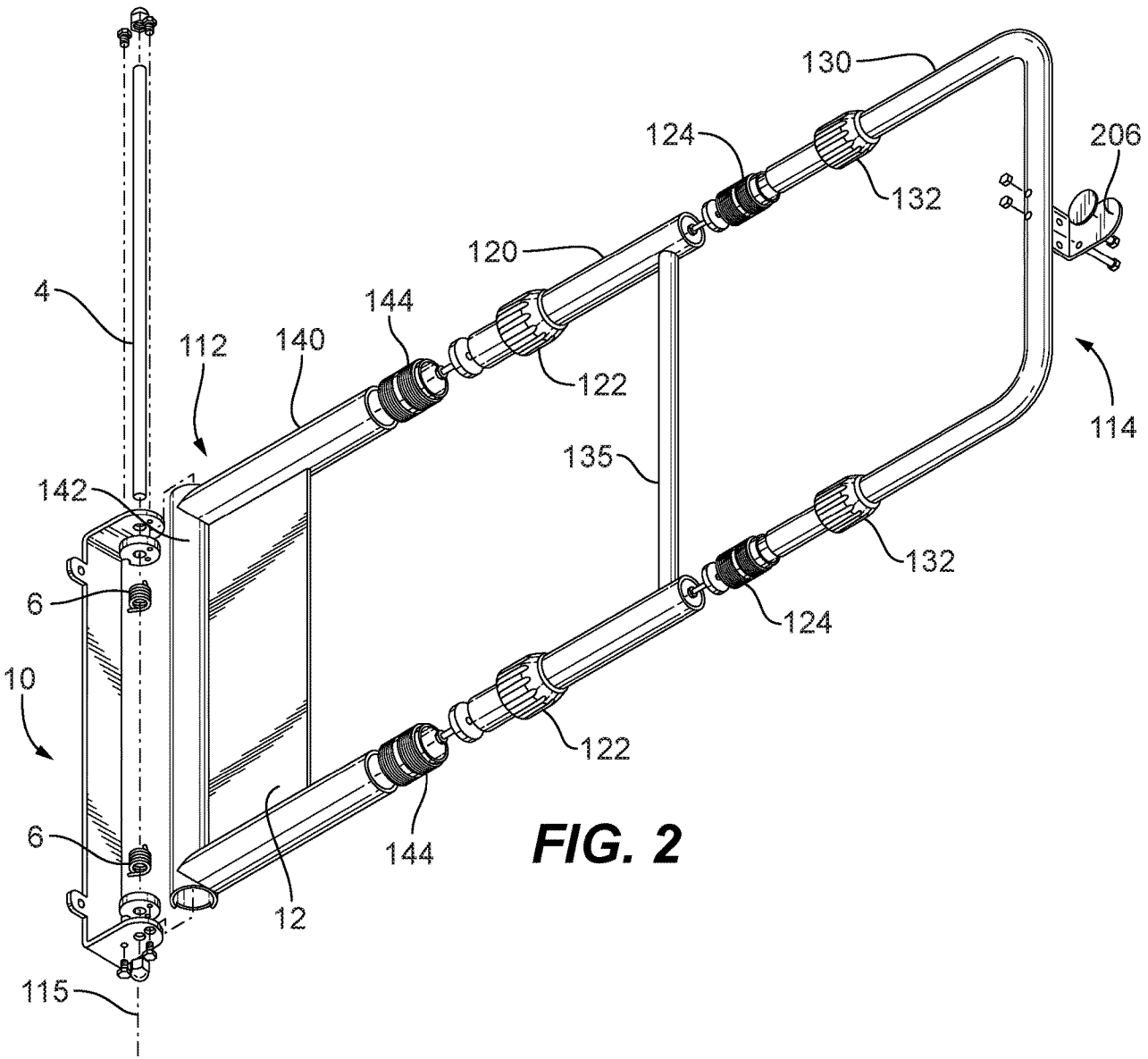
FIG. 2 shows an exploded view of the telescoping swing gate of FIG. 1 according to aspects of the present invention.

FIG. 2 illustrates an exploded view of the frame 110 and the pivoting hinged connection with the mounting seat 10. The hinge tube 142 of the pivot member 140 can be disposed around a cylindrical shaft 4 defining an axis of rotation 115 for the frame 110 and couples both the mounting seat 10 and frame 110 along the axis 115. Shaft 4 can be an elongate body sized to be received in hinge tube 142. Portions of the shaft 4 can be supplied with one or more torsion springs 6 so the gate is spring loaded to automatically close behind a user and prevent the frame 110 from unintentionally swinging towards, or being left in, an open position. The hinge tube 142 can be designed to receive and restrain torsion springs 6 through the use of machined recesses or other features. Torsion springs 6 are commonly used in the art and can be oriented, in one example, in the hinge tube 142 where one end of the spring rests in a recess or against a fixed interior wall of the frame 110 and the other end is coupled with the angular swinging motion of the gate so that the spring is compressed as the gate is opened. Upon release, the torsion spring 6 returns to its uncompressed state to urge the gate towards the closed position. This provides a safe environment, eliminates the need for a latching mechanism, and avoids the possibility for human error.

The pivot member 140 can have one or more stabilizer plates 12 which can serve as bracing for the proximal end 112 of the frame 110 where loads applied near the distal end 114 of the frame induce the greatest bending moment and potential deflection. The stabilizer plate 12 can be a sheet as shown or can assume other geometry which can be, for example welded to the segments of the pivot member 140 but preferably extends the full height of the pivot member to directly link the top and bottom of the frame 110 near the proximal end 112 in order to secure the frame 110 between the top and bottom rail portions.

Inner connectors 124, 144 can be partially housed within the tubular free ends of the pivot member 140 and first telescoping member 120. In one example, inner connectors 124, 144 can have one or more mounting surfaces with threads, a channel, or a spline so that proximal and distal collars 122, 132 can be rotated to lock or unlock the telescoping capability of the first and second telescoping members 120, 130. The inner connectors then function as a sleeve for the telescoping motion. Extension axis 111 indicates the opposing directions in which the telescoping members can be capable of sliding. When tightened onto the inner connectors 124, 144, the proximal and distal collars 122, 132 can create a compressive friction fit for holding in place the relative longitudinal position of the telescoping members. The inner connectors 124, 144 and the proximal and distal collars 122, 132 can thus serve to fix the length of the gate 100 along the extension axis 111 between new or pre-existing structures, such as a post and a wall or between two walls or two posts.

Clapper plate 206 can be removably mounted to the second telescoping member distal end 114 of the frame 110 as shown in FIG. 2. In this instance, once the frame 110 is properly adjusted to the appropriate length of the opening to be blocked using the telescoping functions noted above, the clapper plate 206 can bridge the final longitudinal gap existing between the gate and adjacent structure (see FIG. 14) so that it overlaps and provides an impingement contact surface to arrest rotation of the frame in the closed configuration.

Figure 3:
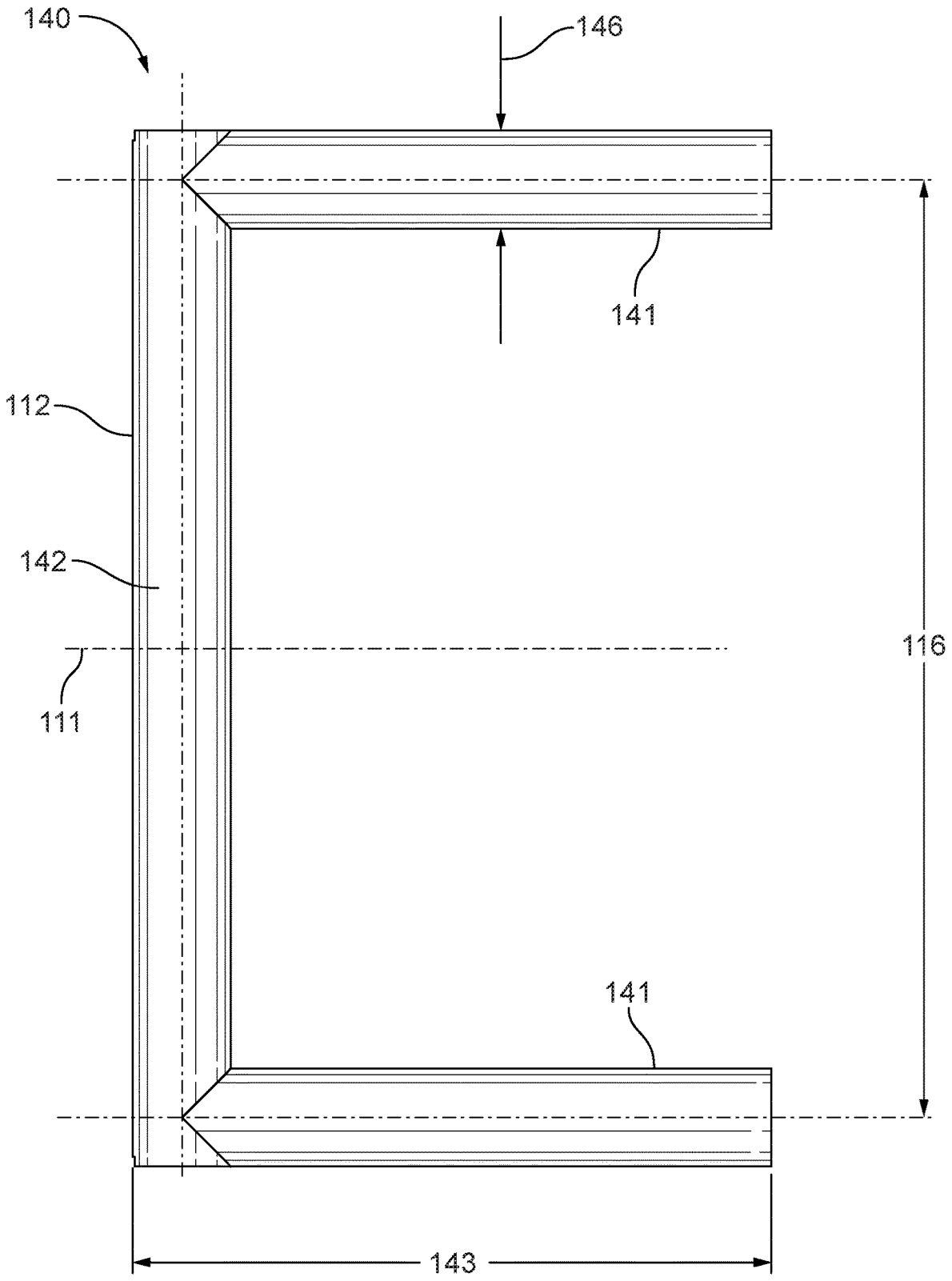
FIG. 3 shows the pivot member of the telescoping swing gate of FIG. 1 according to aspects of the present invention.

Pivot member 140 can have a base consisting of a vertically aligned hinge tube 142 which allows the pivot member to be swingable with respect to the mounting seat 10, as seen in FIG. 3. A plurality of longitudinal members 141 parallel to the extension axis 111 can have their proximal ends secured to the hinge tube 142. The hinge tube 142 can be axisymmetric with the rotation axis 115 and serve as a housing for the self-closing shaft and spring assembly as set forth in detail above.

The longitudinal members 141 can be substantially tubular such that they provide a distal insertion opening for the first telescoping member 120. The longitudinal members 141 can be sized with an inner diameter appropriate for the first telescoping member and an outer diameter 146 sized to be of standard tube stock or oversized for additional structural support and rigidity. In one example, the outer diameter 146 of the longitudinal members 141 can be in the range of 35-65 mm. In another example, the outer diameter 146 can be approximately 50 mm.

The vertical distance between the centerlines of the upper and lower longitudinal members 141 can define a centerline height 116 for the frame 110. It can be assumed that "lower" members are referred to as looking from the bottom of the frame up. In other words, "lower" members can be those most near the working surface. The centerline height 116 can be consistent at all axial locations along the length of the frame 110 to ensure proper orientation of the telescoping members and assure they are aligned and at the correct height. The alignment allows the telescoping capabilities of the frame to function without binding.

Figure 4:
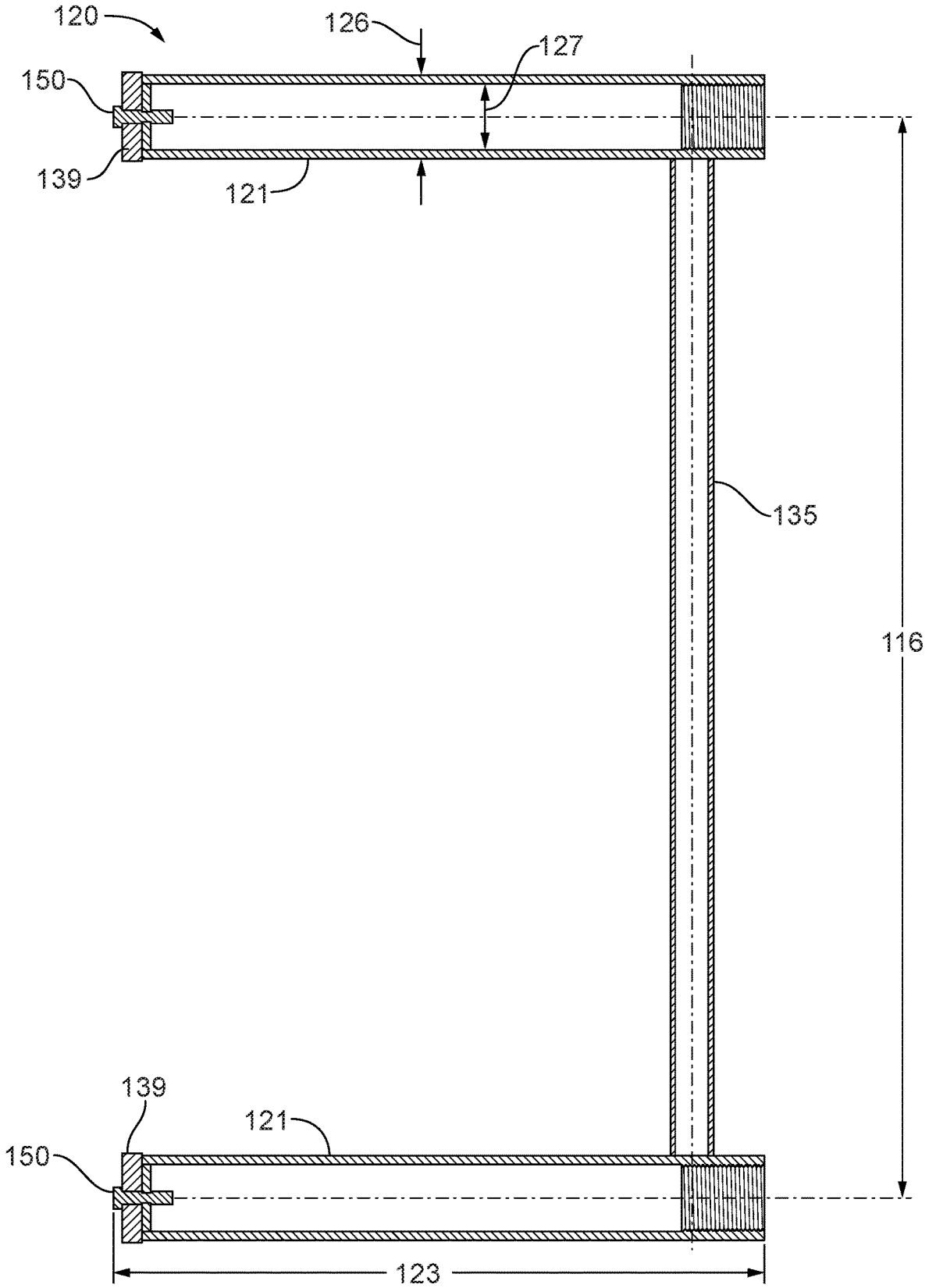
FIG. 4 is a view of the first telescoping member of the telescoping swing gate of FIG. 1 according to aspects of the present invention.

FIG. 4 shows a first telescoping member 120 with longitudinal members 121 and a vertical cross support 135. Longitudinal members 121 can be substantially tubular such that they provide a distal insertion opening for the second telescoping member 130. The proximal portions of the longitudinal members 121 are configured to slide and telescope within the longitudinal members 141 of the pivot member 140 along at least a portion of the length 123 of the first telescoping member 120. The overall length 123 of the member can be, for example, in a range between 300-350 mm or can be limited to a more specific value for structural reasons, such as 335 mm.

Similarly, dimensions of the longitudinal member 121 tubes for the first telescoping member 120 can be selected so the frame 110 can maintain rigidity in bending even when the frame is fully extended. can be in the range of 30-50 mm. In another example, the outer diameter 126 can be approximately 40 mm, so that the ratio of the outer diameter 146 of the pivot member 140 to the outer diameter 126 of the first telescoping member 120 can be approximately 5:4.

Proximally the longitudinal members can have an end block 135 secured with a bolt 150. Bolt 150 can be a conventional bolt having a length long enough to pass through the end block 135 and be secured with either female threads, a nut, or other suitable method. When the longitudinal members 121 are sliding within the pivot member 140, the end block 135 can serve as a physical stop to limit the proximal and/or distal translation of the telescoping member 120. The end block can be a wide variety of potential materials, so long as it has sufficiently high modulus with limited elasticity. For example, the block can be a synthetic thermoplastic polymer like nylon that is relatively inexpensive and easy to manufacture.

First telescoping member 120 can have a cross support 135 as a structural brace. Whereas the stabilizer plate 12 supports the proximal end 112 of the frame 110, cross support 135 can transfer and support loads mid-span as the frame is telescopically expanded to greater lengths. Cross support 135 can be a vertical slat or tube which has an upper end and a lower end secured to the upper and lower rails of the longitudinal members 121. The cross support 135 can be secured to the longitudinal members 121 by means of fasteners, welding, or other suitable methods. Cross support 135 can also serve as a gripping surface which a user can push or pull to slide the first telescoping member 120 to a different position along the extension axis 111 and/or swing the gate.

Figure 5:
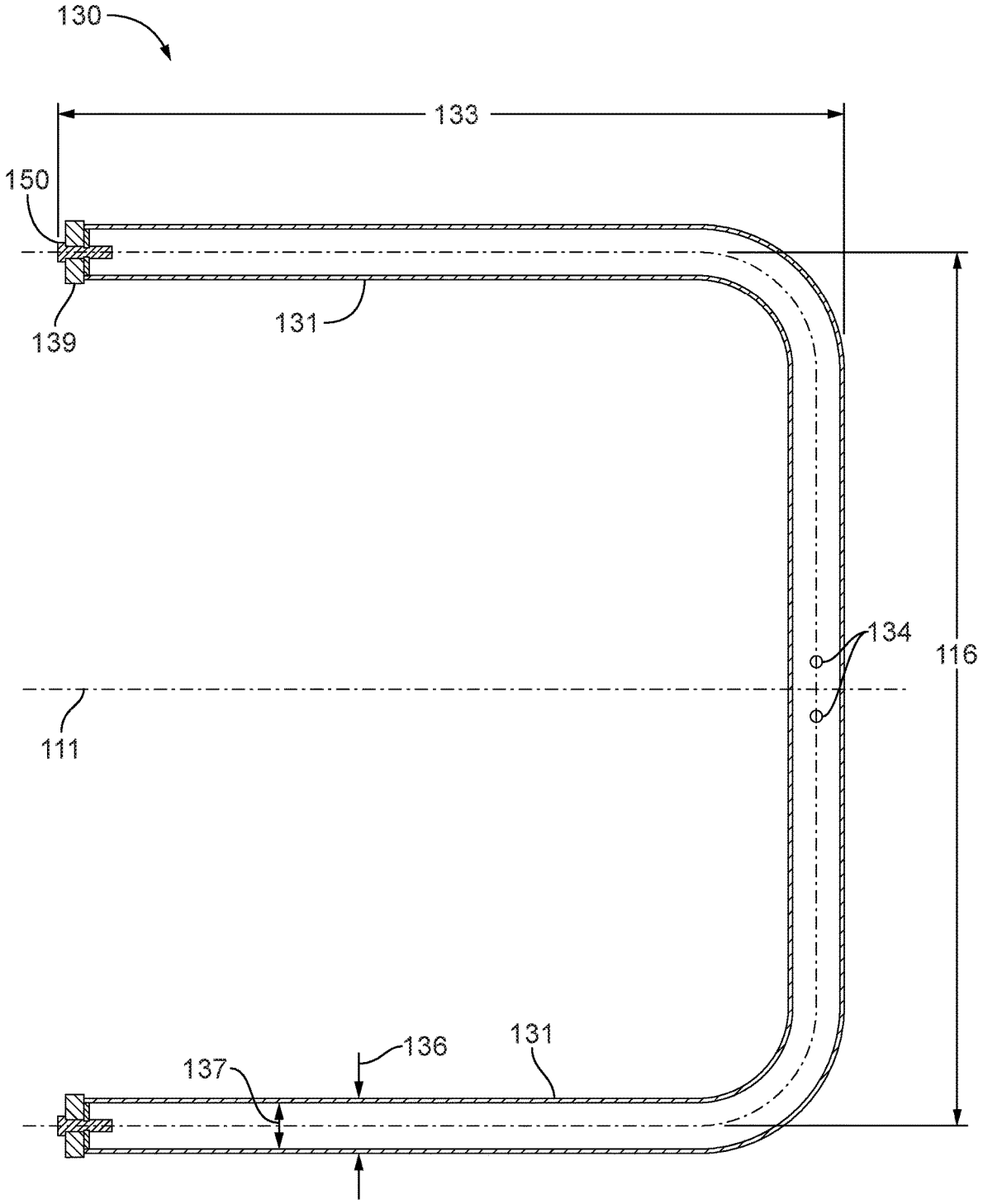
FIG. 5 illustrates the second telescoping member of the telescoping swing gate of FIG. 1 according to aspects of the present invention.

The second telescoping member 130 can be of substantially tubular construction with a U-shaped profile, similar to that shown in FIG. 5. In one example, the second telescoping member 130 can be formed from a continuous piece of tube stock and bent with a radius so that it can have two longitudinal members 131 linked distally with a vertical member. The tube stock can have a specified outer diameter 136 and inner diameter 137. The second telescoping member can also share the same centerline height 116 as the pivot member 140 and first telescoping member 120 so that the relative sliding of the individual frame components during extension or retraction along the extension axis 111 is smooth. Mounting holes 134 can be added which can provide for the fitting of the clapper plate 206 to extend beyond the distal end 114 of the frame and be a contact surface for an outside member to arrest rotation of the frame 110 when it pivots closed from an open position.

Similar to the first telescoping member 120, the second telescoping member 130 can have the proximal portions of the longitudinal members 131 be configured to slide and telescope within the longitudinal members 121 of the first telescoping member 120. At least a portion of the length 133 will overlap with the length of the first telescoping member 120. The overall length 133 of the member can be in a range between 400-450 mm or can be limited to 430 mm to control the amount of the second telescoping member 130 that is cantilevered at the distal end 114 of the frame 110 when in the extended state.

The inner diameter 137 and outer diameter 136 of the tube stock define the wall thickness of the second telescoping member and subsequently influence the amount of force which can be sustained by the frame 110 when loads are applied near the distal end 114 of the frame. The outer diameter 136 can be, for example, approximately 30 mm so that the ratio of the outer diameter 146 of the pivot member 140 to the second telescoping member 130 can be 5:3. Similarly, the ratio of the outer diameter 126 of the first telescoping member 120 to the second telescoping member 130 can be 4:3

Figure 6:
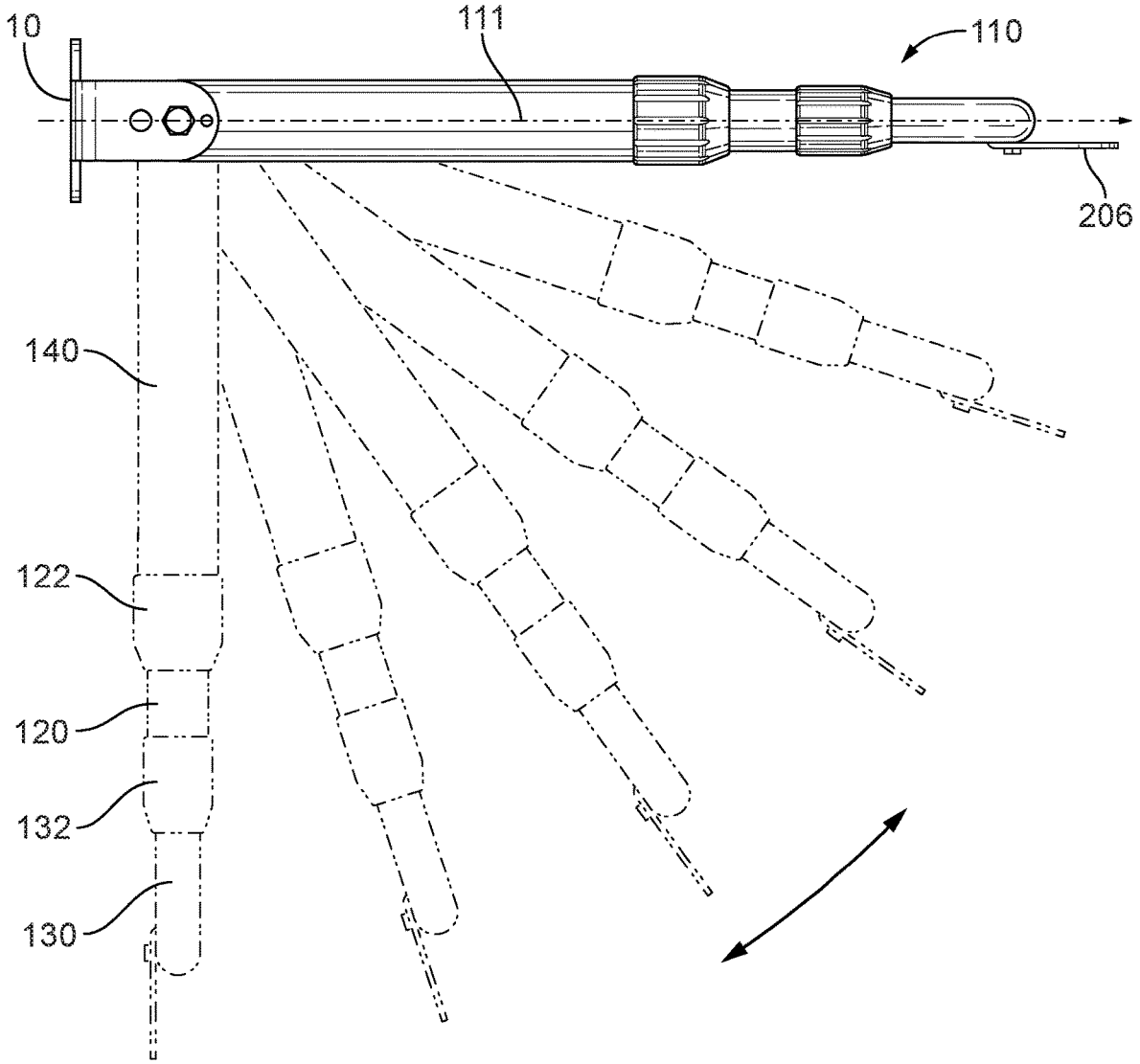
FIG. 6 is a top view of the is a view of a telescoping swing gate demonstrating the swinging action according to aspects of the present invention.

Rotation of the frame 110 between the open position and the closed position can take place regardless of the extent to which the frame is extended between the collapsed state and the fully extended state. Full rotation of the frame 110 from the closed position to the open position can be approximately 90 degrees, as shown from the top in FIG. 6, or can be some other angle. While the clapper plate 206 can be used to stop and seat the gate 100 when closed, the shape of the mounting seat 10 bracket can also serve as a natural barrier to prevent over rotation of the gate frame when opened.

The design can be configured to accommodate many different doorway requirements. The gate 100 as shown in many of the described examples can be largely axisymmetric about the extension axis. This means the disclosed design can easily be configured in a right-hand hinged inwardly opening gate, a right-hand hinged outwardly opening gate, a left-hand hinged inwardly opening gate, or a left-hand hinged outwardly opening gate. In many cases the gate will open inward, such as at the top of a ladder opening. The gate can also be configured with a more highly stressed spring system at the hinge for situations where a greater closure force is desirable, such as in windy outdoor environments. The spring force or tension can also be made to be adjustable. This can be accomplished by, for example, by linking the ends of one or more of the coiled torsion springs 6 to a gear. These factors combine to increase the utility of the gate 100 for a more universal overall design.

Figure 7:
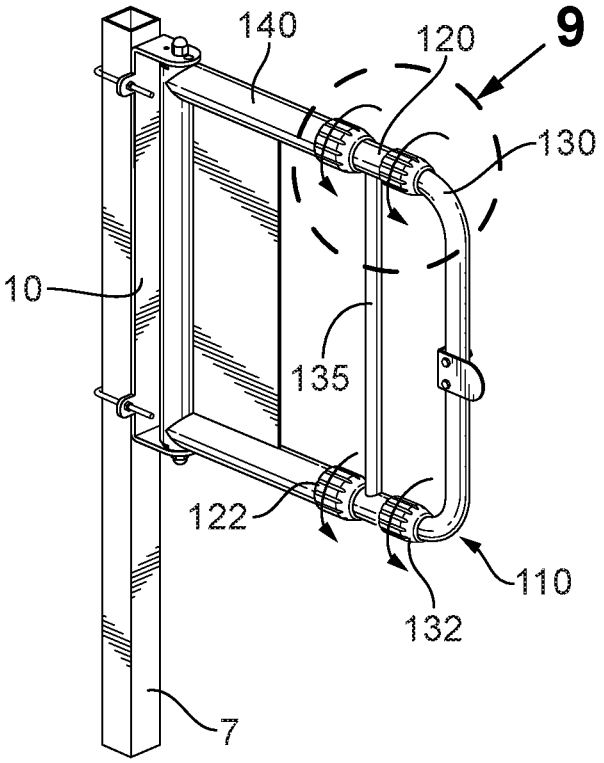
FIG. 7 illustrates the use of the proximal and distal collars to unlock the telescoping features of the first and second telescoping members according to aspects of the present invention.
Figure 8:
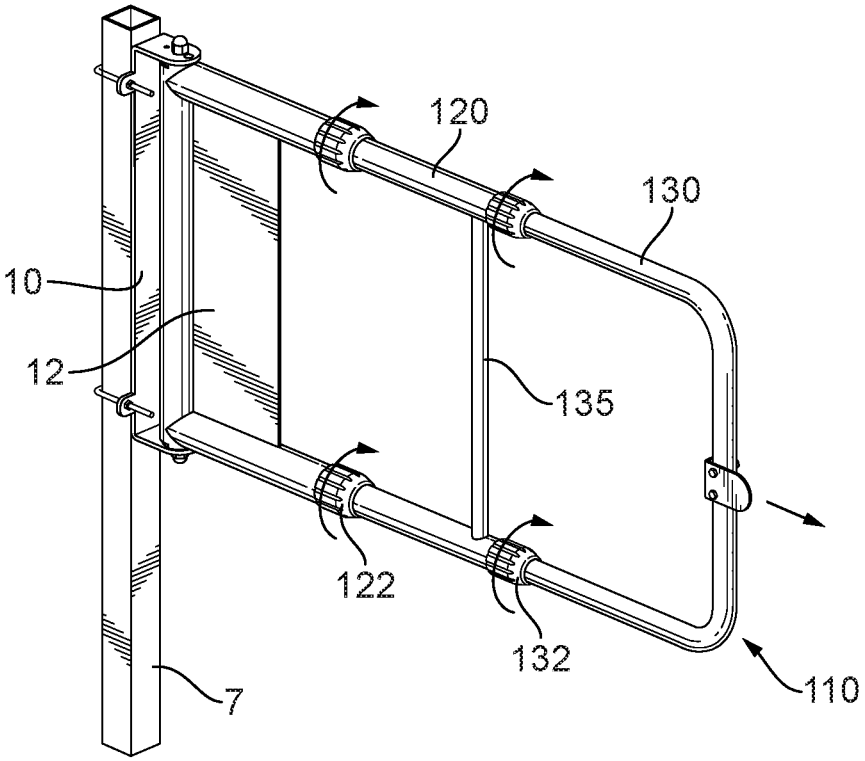
FIG. 8 is a view of the use of the proximal and distal collars to lock the telescoping features of the first and second telescoping members of the extended swing gate according to aspects of the present invention.

FIG. 7 and FIG. 8 show one possible actuation sequence for changing the length of the gate to service different sizes of openings. The frame can begin in the collapsed state, as shown in FIG. 7, with the user wanting the adjust the frame to cover a larger opening. To unlock the telescoping capabilities of the first telescoping member 120, the proximal collars 122 on the frame can be rotated in a clockwise (when viewed from the proximal end) direction. Once rotated, the user can pull the first telescoping member 120 in the direction of the arrow distally to extend the frame to cover a greater opening. Square post 7 provides a base to which mounting seat 10 is attached and reacts against distally or proximally applied forces when adjusting the length 113 of the frame 110. Similarly, the distal collars 132 can also be rotated to allow the second telescoping member 130 to be extended. When the desired extension is reached, the proximal collars 122 and distal collars 132 can be rotated in the opposite direction to lock the desired position, as shown in FIG. 8. In practice, the frame length 113 is therefore infinitely adjustable between the collapsed state and the fully extended state.

Figure 9:
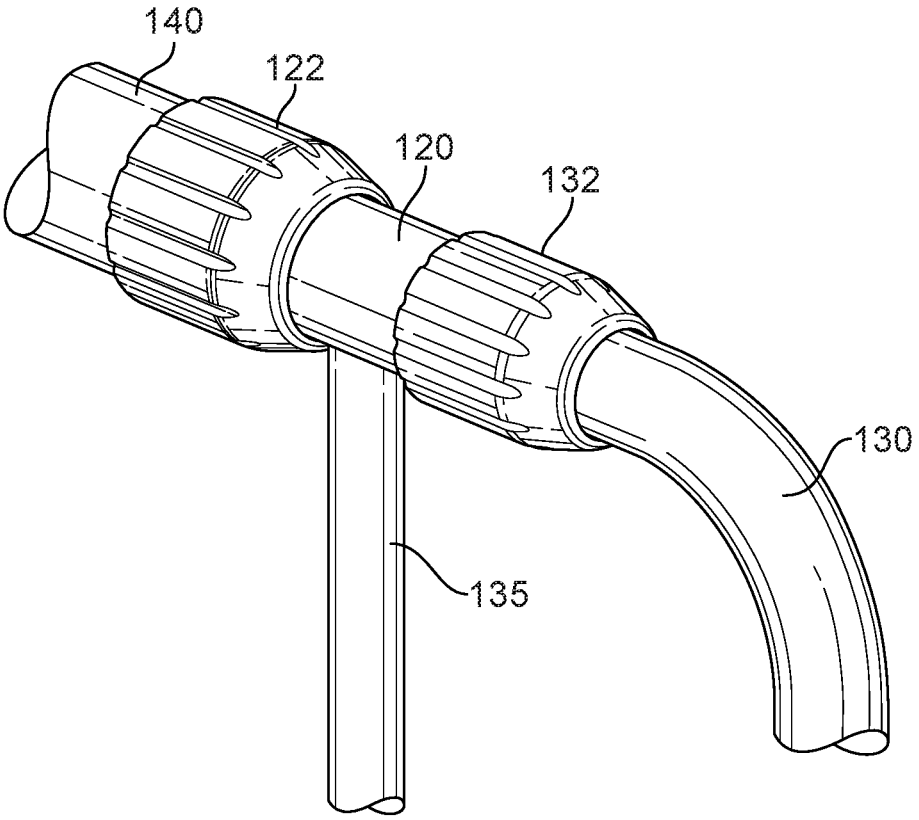
FIG. 9 shows a closer look of the proximal and distal collars according to aspects of the present invention.

A close-up view of an example collar arrangement showing a proximal collar 122 and distal collar 132 is show in FIG. 9. Cross support 135 can be positioned at an axial position intermediate of the proximal collar 122 and distal collar 132. The collar exteriors can have a grooves, knurling, or similar pattern for ease of grip. In another example the collars can be stationary sleeves for the insertion of set screws or other securing members to lock the extended positions of the first telescoping member 120 and second telescoping member 130. Alternately, a spline or sloped keyway can be used to compress the joint when the collars are threaded axially. It can also be appreciated that after assembly proximal collar 122 and distal collar 132 can appear substantially identical in physical appearance with the exception that proximal collar 122 can have a larger external size due to the diameters of the respective longitudinal members.

The proximal collar 122 and distal collar 132 can be partially threaded internally or fully threaded. In practice, only a small amount of rotation may be needed to remove the compressive force on the internal joint with the inner connectors 124, 144 under the collar and allow axial motion of the telescoping members. Telescoping members 120, 130 can slide freely because the joint can be configured so only a small component of force is directed in the vertical direction, because the expected forces on the gate 100 when in operation are not expected to be significantly directed in the longitudinal direction.

Figure 10:
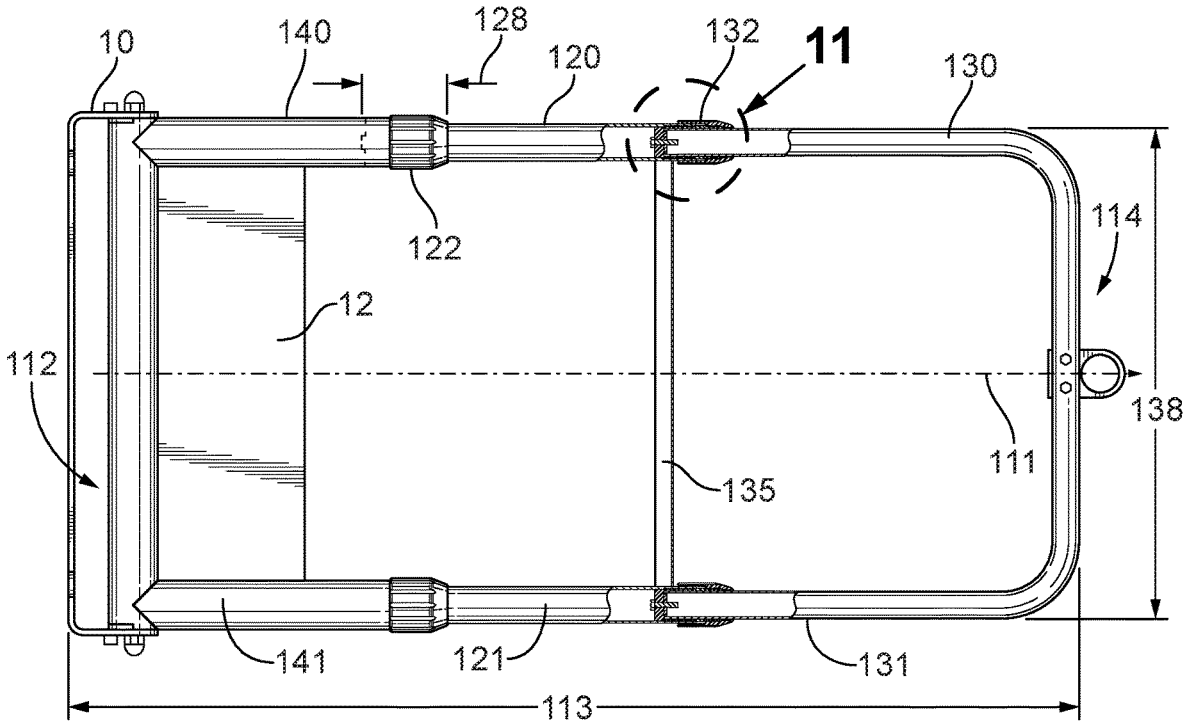
FIG. 10 is a side view of an extended telescoping swing gate according to aspects of the present invention.

FIG. 10 shows the frame 100 in a fully extended state where there is minimal overlap between the longitudinal member 141 of the pivot member 140 and the longitudinal member 121 of the first telescoping member 120. The amount of overlap can be defined by the first sheath length 128 where the lumen of the pivot member 140 serves as a sheath for the longitudinal member 121 of the first telescoping member 120. A similar overlap occurs between the first telescoping member 120 and the second telescoping member 130 to define a second distal sheath length 129. While a greater variability of possible frame lengths 113 means a more versatile the gate, large lengths can also increase the bending moment experienced near the mounting seat 10. Larger sheath lengths tube gages can be used to manage the moments and create better stiffness transitions to reduce stress concentrations and share loads, as the joints between the frame members are more reinforced. In this state the stabilizer plate 12 and cross support 135 also play an important role in maintaining the vertical stiffness of the frame 110.

As the safety swing gate 100 is often used on and around walking-working surfaces containing scaffolding and guardrail systems. Such guardrail systems are required to conform with requirements laid out by the Occupational Safety and Health Administration (OSHA) for the safety and well-being of workers. For example, OSHA 1910.21 defines the dimensional and structural requirements for guardrail systems for platforms, hoist areas, and other surfaces. In one such requirement, guardrail systems must be capable of withstanding, without failure, a force of at least 200 lbs. (890 N) applied in a downward or outward direction at any point along the top edge of the rail. Careful design of the gate dimensions herein can allow the gate 100 to meet the defined requirements of adjacent guardrail segments that other designs in the art cannot meet, thus ensuring a more continuous and safely protected work boundary.

In addition to those listed previously for the pivot member 140, first telescoping member 120, and second telescoping member 130, assembly dimensions for the frame 110 are also important to ensure the management of structural transitions between the various members. In one case, the ratio of a first length of the first telescoping member to a second length of the second telescoping member can be approximately 0.78 to have the frame supported over greater portion of its cantilevered length. For example, the length 113 can be a minimum of around 500 mm when the frame is fully collapsed and grow by up to 80% or more when fully extended. In another example, the length can be 560 mm when collapsed and 1015 mm when fully extended. The pivot member does not telescope with respect to the rest of the frame, and thus contributes a fixed length 143 to the assembled frame length 113 no matter the relative axial positions of the first telescoping member 120 and second telescoping member 130. As a result, because of the overlap in the frame 110 at the location of the first sheath length 128 and second sheath length 129 the pivot member can account for approximately 50-60% of the total assembly frame length 113 when the gate is fully collapsed. Subsequently, when the members are fully extended the first sheath length 128 and second sheath length 129 decrease since there is less overlap between the posts of the members, and the contribution of the fixed length of the pivot member 140 can decrease to approximately 30% of the total extended frame length 113.

Although not illustrated in the example shown, frame 110 can also have further cross supports, glass paneling, or other members to block of larger regions of the interior spaces so that items such as tools or equipment on and around the work surface can be better contained by the frame. These members can also help to distribute bending loads between the longitudinal members forming the upper and lower rails of the frame.

A distal frame height 138 can be used to describe the distance between the top and bottom rails of the frame, or the vertical component of the frame perimeter. In one example, the distal frame height 138 can be approximately 20 in (508 mm) so that when the top of the frame is positioned at the standard OSHA guardrail height of 42 in, the lower longitudinal members 121, 131, 141 of the frame run approximately min span between the working surface and the top of the frame 110.

Figure 11:
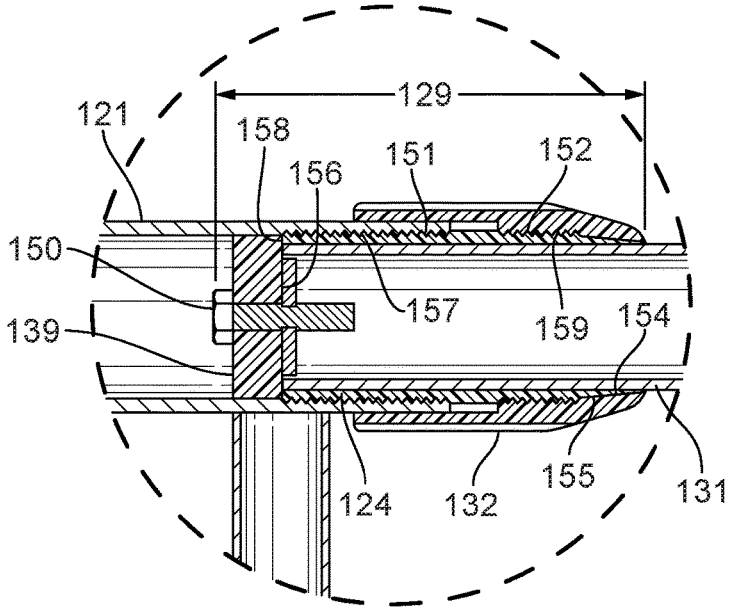
FIG. 11 is a cross section through the interface of one of the distal collars according to aspects of the present invention.

A cross section of one of the telescoping joints from FIG. 10 having an inner connector 124 and an outer distal collar 132 is shown in FIG. 11. Inner connector 124 can be attached to the inner post of longitudinal member 121 through proximal threads 151 as shown to engage with the threads 157 of the longitudinal member. Alternately, inner connector 124 can be affixed using adhesives or some other means. As the longitudinal member 131 of the second telescoping member 130 moves proximally within the longitudinal member 121 of the first telescoping member 120, sheathing length 129 increases to indicate the overlap of the members.

The end block 139 can be affixed to the end of the post of the longitudinal member 131 and sized to have a distal face 156 with a larger outer diameter than the inner diameter of the connector 124. In this way the end block 139 is keyed so that the distal face 156 prohibits the posts of the telescoping member 130 from sliding distally beyond the leading edge 158 of the inner connector 124. As the longitudinal member 131 moves distally to increase the frame length 113, end block 139 slides within longitudinal member 121 in the direction of the inner connector 124. Eventually, end block 139 reaches the leading edge 158 of inner connector 124 at which point the inner connector serves as a physical stop preventing further telescoping of the longitudinal member 131. When both the first telescoping member 120 and the second telescoping member 130 reach the physical stops provided by the first inner connectors 144 and second inner connectors 124, respectively, frame length 113 reaches its maximum and the frame is in the fully extended state to cover the largest possible opening for which the gate is capable.

Approximate the distal end, the collar 132 and the inner connector 124 can have an extended beveled surface where and incline or taper 155 creates a chamber that is largely conical shaped, similar to that of a thrust collar. When threads of the collar 132 have engaged with the distal threads 152 of the inner connector 124 to draw the collar proximally as it is tightened, the inclined interface 154 between the inner end of the collar and the outer end of the connector 124 become engaged. The inclined surface 154 of the inner connector 124 impinges on taper 155 of the collar 132 to serve several different functions. First, as the collar 132 is moved proximally over the inner connector 124, the connector inclined surface 154 serves as a centering tool to align and properly seat the components concentrically. Second, as the threads 152 of the collar are tightened, the radial component of the reaction force between the surfaces compresses longitudinal member 131 with respect to longitudinal member 121 to effectively lock the joint at a specific sheathing length 129 and frame length 113.

Figure 12:
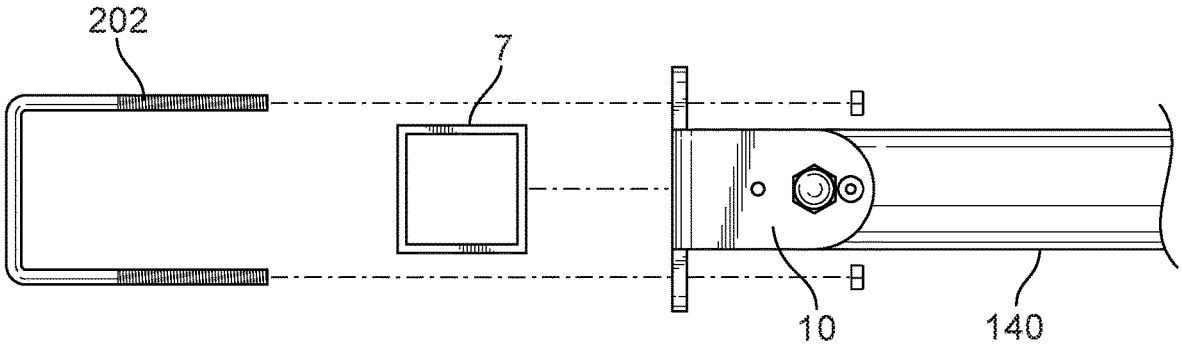
FIG. 12 shows an example where a telescoping swing gate is bolted to a square post according to aspects of the present invention.
Figure 13:
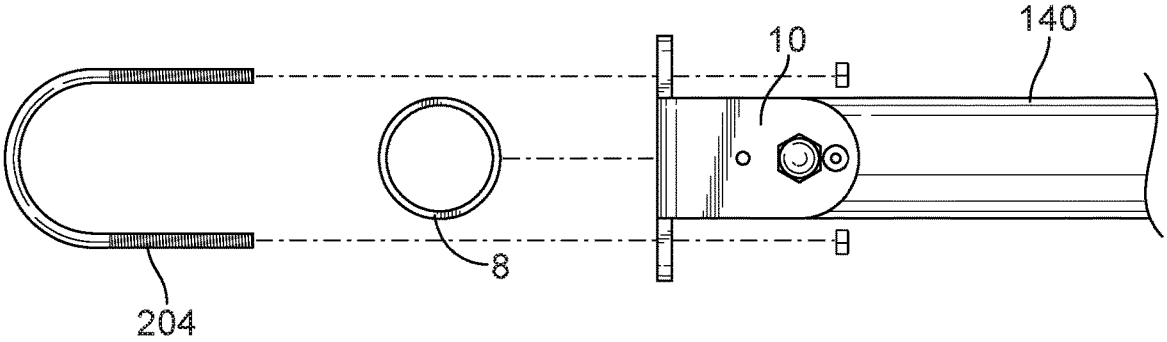
FIG. 13 shows another example where a telescoping swing gate is bolted to a round post according to aspects of the present invention.

Referring to FIG. 12 and FIG. 13, the universal aspects of the swing gate designs herein include their ability for attachment to an array of different configurations expected to be encountered on a job site. For example, in applications where scaffolding has been erected to create and protect temporary work surfaces, the surrounding structure is likely to contain a variety of vertical posts which can be a functional part of a temporary guardrail system and/or supportive truss members for the site. The gate can be supplied with various mounting hardware to allow for interfacing with these members.

FIG. 12 shows a situation where the mounting seat 10 of the gate 100 utilizes a square U-bolt 202 for attachment to a square post 7. Square U-bolt 202 prevents unwanted rotation of the mounting seat 10 with respect to post 7 when rotational torque loads are experienced to rotate pivot member 140 about the axis of rotation 115. Similarly, FIG. 13 shows an instance where mounting seat 10 is connected instead to a round post 8 using a rounded U-bolt 204. When mounting to a post as seen in these examples, the gate can readily be flipped to create a right-handed or left-handed opening as desired.

Figure 14:
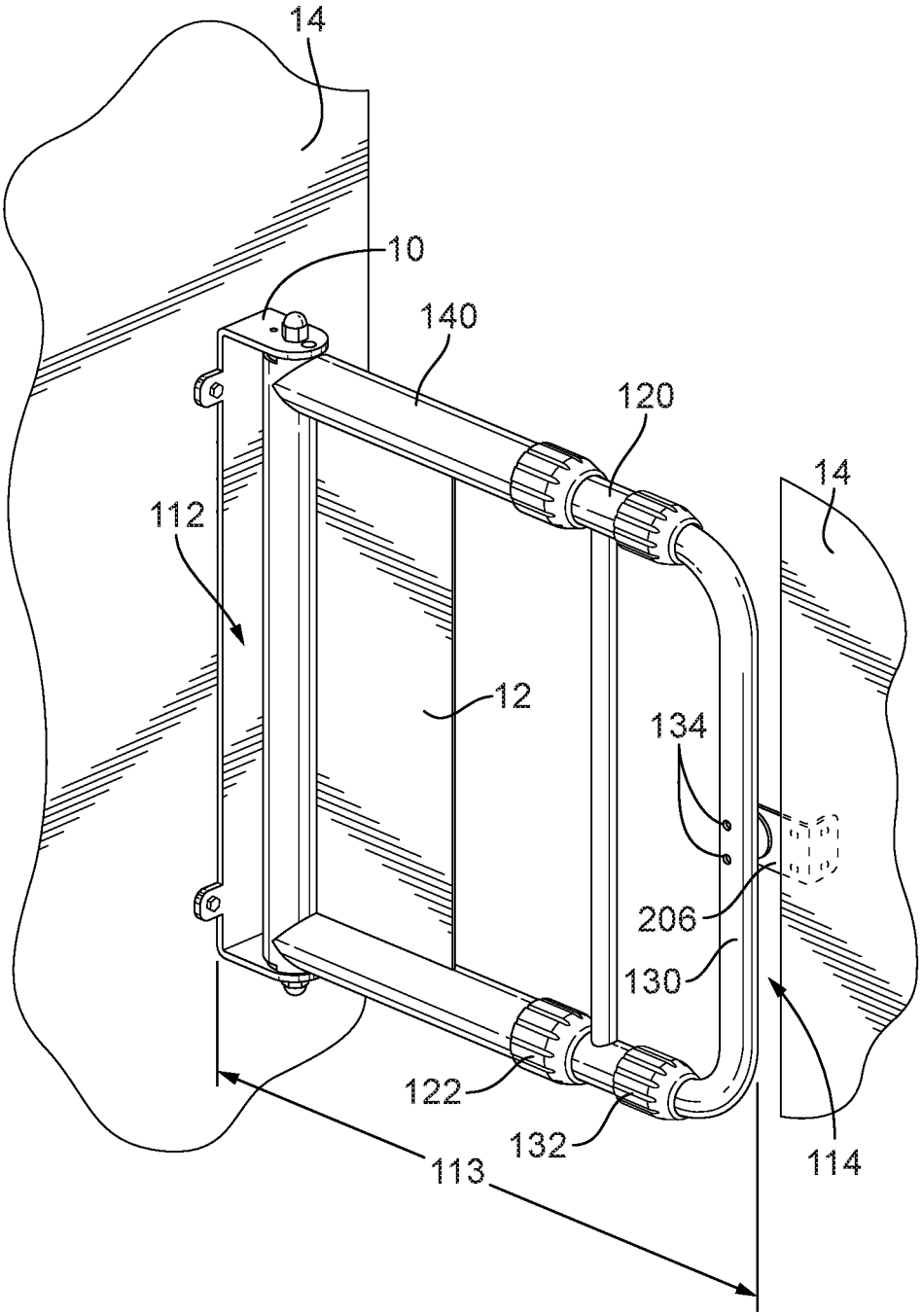
FIG. 14 illustrates how a telescoping swing gate and clapper plate can be configured to mount to an external planar surface according to aspects of the present invention.

A different attachment configuration for the gate 100 is illustrated in FIG. 14. Instead of mounting to an exposed post as seen in FIG. 12 and FIG. 13, the mounting seat 10 can bolted, screwed, adhered, or otherwise coupled to an external member. The external member can be a planar surface, such as a flat bulkhead or wall 14, larger than the footprint of the mounting seat (10) so that the gate has a stable base which allows the frame 110 to rotate with respect to the wall 14.

In another example, the clapper plate 206 can be removed from the mounting holes 134 in the second telescoping member 130 and secured at a fixed distance from the proximal end 112 of the frame 110 when the first telescoping member 120 and second telescoping member 130 have been selectively extended to the desired positions for a length 113 application chosen by a user. The clapper plate 206 is thus not attached to the second telescoping member as in previous examples but is a contact surface in operative communication with the distal end 114 of the frame 110 to stop rotation of the gate when it reaches the closed position.

The invention is not necessarily limited to the examples described, which can be varied in construction and detail. The terms "distal" and "proximal" are used throughout the preceding description and are meant to refer to a positions and directions relative to the fixed mounting base for the gate. As such, "distal" or distally" refer to a position distant to or a direction towards the free end of the gate. Similarly, "proximal" or "proximally" refer to a position near to or a direction towards the base or mounting seat of the gate. Furthermore, the singular forms "a," "an," and "the" include plural referents unless the context clearly dictates otherwise.

As used herein, the terms "about" or "approximately" for any numerical values or ranges indicate a suitable dimensional tolerance that allows the part or collection of components to function for its intended purpose as described herein. More specifically, "about" or "approximately" may refer to the range of values ±20% of the recited value, e.g. "about 90%" may refer to the range of values from 71% to 99%.

In describing example embodiments, terminology has been resorted to for the sake of clarity. It is intended that each term contemplates its broadest meaning as understood by those skilled in the art and includes all technical equivalents that operate in a similar manner to accomplish a similar purpose without departing from the scope and spirit of the invention. It is also to be understood that the mention of one or more steps of a method does not preclude the presence of additional method steps or intervening method steps between those steps expressly identified. Similarly, some steps of a method can be performed in a different order than those described herein without departing from the scope of the disclosed technology. For clarity and conciseness, not all possible combinations have been listed, and such variants are often apparent to those of skill in the art and are intended to be within the scope of the claims which follow.

What is claimed is:

1. A safety gate comprising:

a frame which is rotatable between an open configuration and a closed configuration, extendable along an extension axis between a collapsed state and a fully extended state, and configured to obscure an opening having a length defined by the perimeter of the frame, the frame comprising:

a pivot member rotatable about a shaft at a proximal end;

a first telescoping member slidably disposed to move along the extension axis relative to the pivot member;

a second telescoping member slidably disposed to move along the extension axis relative to the pivot member and first telescoping member;

one or more proximal collars disposed on the pivot member and configured to rotate around the pivot member to lock and unlock a first relative position of the first telescoping member relative to the pivot member; and one or more distal collars disposed on the first telescoping member and configured to rotate around the first telescoping member to lock and unlock a second relative position of the second telescoping member relative to the first telescoping member; and a mounting seat comprising hardware for attaching the gate to an external member, the frame pivotably mounted and rotatable with respect to the mounting seat;

where the length increases by about 80% when the frame is extended from the collapsed state to the fully extended state.

2. The safety gate of claim 1, further comprising one or more torsion springs configured to nominally bias motion from the open configuration to the closed configuration.

3. The safety gate of claim 1, the mounting seat configured to be attached to the external member beyond the perimeter of the frame.

4. The safety gate of claim 3, wherein the external member is a post.

5. The safety gate of claim 3, wherein the external member is a planar surface larger than the mounting seat.

6. The safety gate of claim 1, further comprising a clapper plate removably disposed at a fixed position along the extension axis relative to the mounting seat.

7. The safety gate of claim 6, the clapper plate removably disposed on the second telescoping member and configured to arrest rotation when the frame is rotated from the open configuration to the closed configuration.

8. The safety gate of claim 6, the clapper plate being removably disposed on a surface external to the gate and configured to arrest rotation when the frame is rotated from the open configuration to the closed configuration.

9. A device for obscuring an opening, the device comprising:

a frame rotatable between an open configuration and a closed configuration and extendable along an extension axis between a collapsed state and a fully extended state, the frame comprising:

a pivot member pivoting at least partially around a shaft at a proximal end;

a first telescoping member slidably disposed to move along the extension axis relative to the pivot member;

a second telescoping member slidably disposed to move along the extension axis relative to the first telescoping member remote from the proximal end;

one or more proximal collars disposed on the pivot member and configured to lock and unlock a first relative position of the first telescoping member relative to the pivot member by respectively rotating in a first and second direction; and one or more distal collars disposed on the first telescoping member and configured to lock and unlock a second relative position of the second telescoping member relative to the first telescoping member by respectively rotating in the first and second direction;

a mounting seat configured to be attached to an external member, the frame rotatable about the shaft with respect to the mounting seat;

one or more torsion springs configured to nominally bias motion of the frame from the open configuration to the closed configuration; and a clapper plate removably disposed at a fixed position along the extension axis relative to the mounting seat;

the length increasing when the frame is extended from the collapsed state to the fully extended state; and the device being configured to obscure an opening defined by a longitudinal length of the device.

10. The device of claim 9, the ratio of an outer diameter of the pivot member to an outer diameter of the first telescoping member being 5:4.

11. The device of claim 9, the pivot member accounting for approximately 55% of the longitudinal length when the frame is in the collapsed state.

12. The device of claim 9, the pivot member accounting for approximately 30% of the longitudinal length when the frame is in the fully extended state.

13. The device of claim 9, the longitudinal length for obscuring the opening being approximately 560 mm when the frame is in the collapsed state.

14. The device of claim 9, the longitudinal length for obscuring the opening being approximately 1015 mm when the frame is in the fully extended state.

15. The device of claim 9, the ratio of a first length of the first telescoping member to a second length of the second telescoping member is approximately 0.78.

16. The device of claim 9, the pivot member having one or more longitudinal arms with an outer diameter of 50 mm.

17. The device of claim 9, an inner diameter of the first telescoping member being greater than an inner diameter of the second telescoping member by approximately 7 mm.

18. The device of claim 9, the ratio of an outer diameter of the first telescoping member to an outer diameter of the second telescoping member being 4:3.

19. The device of claim 9, wherein the one or more proximal collars are configured to lock and unlock the first relative position of the first telescoping member relative to the pivot member by respectively rotating in the first and second direction around a circumference of the pivot member.

20. The device of claim 9, wherein the one or more distal collars are configured to lock and unlock the second relative position of the second telescoping member relative to the first telescoping member by respectively rotating in the first and second direction around a circumference of the first telescoping member.

21. The device of claim 9, wherein the length increasing by about 80% when the frame is extended from the collapsed state to the fully extended state.

* * * * *